US009410358B2

(12) United States Patent
Raggio

(10) Patent No.: US 9,410,358 B2
(45) Date of Patent: Aug. 9, 2016

(54) VACUUM INSULATED GLASS PANEL WITH SPACERS COATED WITH MICRO PARTICLES AND METHOD OF FORMING SAME

(75) Inventor: William Raggio, Del Mar, CA (US)

(73) Assignee: RAYOTEK SCIENTIFIC, INC., San Diego, CA (US)

( * ) Notice: Subject to any disclaimer, the term of this patent is extended or adjusted under 35 U.S.C. 154(b) by 1282 days.

(21) Appl. No.: 13/310,895

(22) Filed: Dec. 5, 2011

(65) Prior Publication Data

US 2013/0142972 A1 Jun. 6, 2013

(51) Int. Cl.

| | |
|---|---|
| ***E06B 3/00*** | (2006.01) |
| ***E06B 3/663*** | (2006.01) |
| *E06B 3/673* | (2006.01) |

(52) U.S. Cl.

CPC ..... *E06B 3/66304* (2013.01); *E06B 3/67304* (2013.01); *E06B 3/67321* (2013.01); *E06B 3/67326* (2013.01); *Y10T 29/49982* (2015.01)

(58) Field of Classification Search

CPC ..... E06B 3/67304; E06B 3/67321; E06B 3/67326; Y10T 29/49982

See application file for complete search history.

(56) References Cited

U.S. PATENT DOCUMENTS

| | | | | |
|---|---|---|---|---|
| 49,167 | A | | 8/1865 | Stetson |
| 3,030,746 | A | | 4/1962 | Firestine et al. |
| 4,138,304 | A | | 2/1979 | Gantley |
| 4,580,371 | A | | 4/1986 | Akhavi |
| 4,653,680 | A | | 3/1987 | Regan |
| 4,683,154 | A | * | 7/1987 | Benson et al. ..... 428/34 |
| 5,124,185 | A | * | 6/1992 | Kerr et al. ..... 428/34 |
| 5,134,039 | A | * | 7/1992 | Alexander et al. ..... 428/614 |
| 5,494,549 | A | | 2/1996 | Oki et al. |
| 5,517,260 | A | | 5/1996 | Glady et al. |
| 5,721,050 | A | | 2/1998 | Roman et al. |
| 5,769,297 | A | | 6/1998 | Loomis et al. |
| 6,083,578 | A | | 7/2000 | Collins et al. |
| 6,420,002 | B1 | | 7/2002 | Aggas et al. |
| 6,677,024 | B2 | | 1/2004 | Jousse et al. |
| 6,946,171 | B1 | | 9/2005 | Aggas |
| 7,070,703 | B2 | | 7/2006 | Benning et al. |

(Continued)

FOREIGN PATENT DOCUMENTS

| | | |
|---|---|---|
| WO | 96/12862 | 5/1996 |

OTHER PUBLICATIONS

Shamrock Technologies NanoFLON(R) P 39B Thermoplastic Grade PTFE Additive, MatWeb Material Property Data, obtained from www.matweb.com on Nov. 18, 2011, 2 pages.

(Continued)

*Primary Examiner* — Donald J Loney
(74) *Attorney, Agent, or Firm* — Thompson Coburn LLP; Matthew Himich

(57) ABSTRACT

A vacuum insulating glass (VIG) panel comprises first and second panels of glass spaced from another with a separation space therebetween. The VIG panel further comprises spacers disposed between the first and second glass panels to define the separation space. The spacers are generally arranged in a matrix between the first and the second glass panels. The spacers are coated with a coating material comprising particles having an average size of less than about 1 micron. The coating material may be polytetrafluoroethylene particles having an average particle size in a range of about 200 nanometers to about 700 nanometers.

12 Claims, 4 Drawing Sheets

(56) References Cited

U.S. PATENT DOCUMENTS

| | | | | |
|---|---|---|---|---|
| 7,976,360 | B2 | 7/2011 | Jaunzemis et al. | |
| 2001/0049031 | A1 | 12/2001 | Bajorek et al. | |
| 2007/0082179 | A1 | 4/2007 | Wade et al. | |
| 2008/0032904 | A1* | 2/2008 | Watanabe et al. | 508/590 |
| 2009/0280415 | A1 | 11/2009 | Koike et al. | |
| 2009/0324858 | A1 | 12/2009 | Jaeger | |
| 2010/0323277 | A1 | 12/2010 | Roberts | |
| 2011/0147219 | A1 | 6/2011 | Lambourne et al. | |

OTHER PUBLICATIONS

Kocer, "Mechanical Deformations in a Vacuum Glazing; a Finite Element Modeling Study", Proceedings Abstract [online], Jun. 20, 2011, Retrieved on Apr. 3, 2012, Retrieved from the Internet: <URL:http://www.gpd.fi/Global/GPD/Finland/Finland%202011/Accepted%20Abstarcts/IGU/Cenk%20Kocer.pdf.

Weinlader et al., "VIG—Vacuum Insulation Glass" [online], Dec. 2005, Retrieved Apr. 3, 2012, Retrieved from the Internet: <URL:http://www.bine.info/fileadmin/content/Publikationen/Projekt-Infos/Zusatzinfos/2008-01_Fachartikel.pdf.

* cited by examiner

VACUUM INSULATED GLASS PANEL WITH SPACERS COATED WITH MICRO PARTICLES AND METHOD OF FORMING SAME

BACKGROUND OF THE DISCLOSURE

This disclosure generally pertains to glazing panels, and more particularly relates to vacuum insulated glazing panels and methods of forming the same. This disclosure provides for an improved window construction using spacers coated with micro particles.

DETAILED DESCRIPTION

Figure 1:
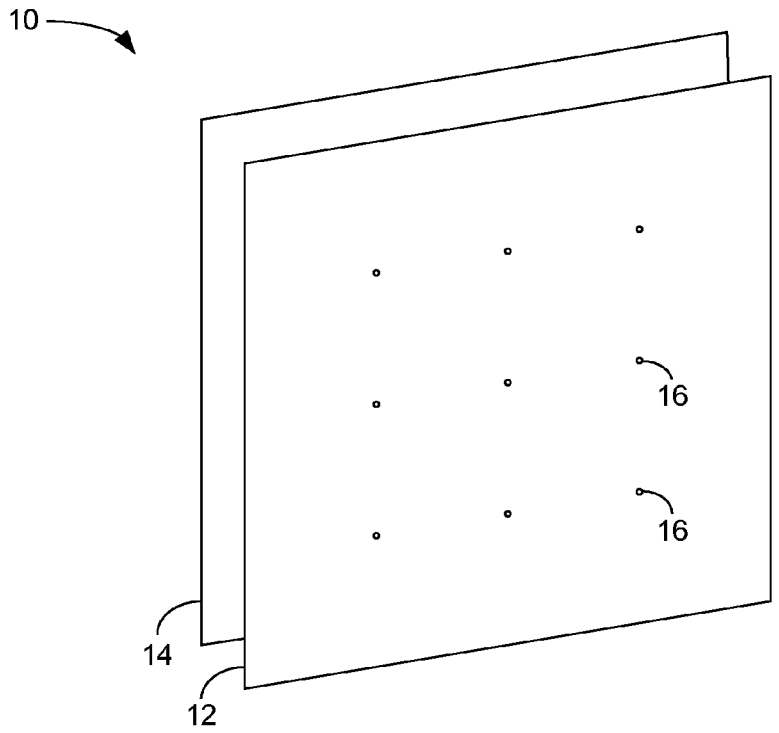
FIG. 1 diagrammatically depicts an embodiment of a vacuum insulated glass (VIG) panel.

Referring to FIG. 1, a vacuum insulated glass (VIG) panel 10 may generally include a first glass panel 12 and a second glass panel 14. The first glass panel 12 and the second glass panel 14 may be spaced from one another. One or more spacers (e.g., a spacer 16) may be disposed between the first glass panel 12 and the second glass panel 14 to define a separation space 18 between the first glass panel 12 and the second glass panel 14. Further, the separation space 18 may be at least partially evacuated.

The first glass panel 12 and the second glass panel 14 may be formed from any suitable glazing material, such as soda lime glass that may be formed using a known float process, or other suitable process. However, it should be appreciated that the material and manufacturing process used to form the first glass panel 12 and the second glass panel 14 may vary depending upon design criteria and the intended application for the VIG panel 10. For example, while common float glass may be utilized for a domestic or residential application, a higher strength material/process may be utilized when the VIG panel 10 is intended for use in a glazing unit in a high rise building, or the like. As such, the present disclosure is not intended to be limited to a specific material or manufacturing process.

As indicated above, the separation space 18 between the first glass panel 12 and the second glass panel 14 may be at least partially evacuated. The at least partial evacuation of the separation space 18 may be maintained via a seal provided between the first glass panel 12 and the second glass panel 14. Examples of suitable seals may include, but are not limited to, a glass frit seal, an elastomeric (such as a rubber or silicone) seal, a metallic seal, or the like. The at least partial evacuation of the separation space 18 may reduce conductive and convective heat transfer between the first glass panel 12 and the second glass panel 14. Additionally, at least one surface of the first glass panel 12 and the second glass panel 14 may include a coating, such as a commercially known low emissivity coating, to minimize radiative heat transfer between the first glass panel 12 and the second glass panel 14. According to some embodiments, the foregoing configuration may be capable of providing the VIG panel 10 having an insulating value in the range of between about R-8 to about R-12.

The spacer 16 may aid in maintaining the separation space 18. For example, the at least partial evacuation of the separation space 18 may result in a relatively low pressure (e.g., a pressure below atmospheric pressure) in between the first glass panel 12 and the second glass panel 14, and a relatively high pressure (e.g., atmospheric pressure) on the outside (e.g., a side opposite the separation space 18) of the first glass panel 12 and the second glass panel 14. The pressure differential between the outside of the first glass panel 12 and the second glass panel 14 and the separation space may result in an inward (i.e., toward the separation space 18) force on the first glass panel 12 and the second glass panel 14. The inward force on the first glass panel 12 and the second glass panel 14 may result in deflection of the first glass panel 12 and the second glass panel 14 toward one another. The deflection of the first glass panel 12 and the second glass panel 14 may result in an excessive strain on one or both of the first glass panel 12 and the second glass panel 14, and the failure (e.g., cracking or complete breakage) of one or both of the first glass panel 12 and the second glass panel 14. Further, even in the absence of failure, the deflection of the first glass panel 12 and the second glass panel 14 may result in contact between the first glass panel 12 and the second glass panel 14. Such contact may result in thermal bridging between the first glass panel 12 and the second glass panel 14. Thermal bridging may allow for conductive heat transfer between the first glass panel 12 and the second glass panel 14, thereby decreasing the insulating properties of the VIG panel 10.

Consistent with the foregoing, the spacer 16 disposed between the first glass panel 12 and the second glass panel 14 may control and/or minimize deflection experienced by the first glass panel 12 and the second glass panel 14. For example, the spacer 16 may act as a compressive, load-bearing member that may resist the inward deflection of the first glass panel 12 and/or the second glass panel 14. As such, the spacer 16 may prevent thermal bridging between the first glass panel 12 and the second glass panel, and may also prevent failure of the first glass panel 12 and the second glass panel 14. As the spacer 16 may be in direct contact with each of the first glass panel 12 and the second glass panel 14, the spacer 16 may desirably have a relatively low thermal conductivity, thereby providing a relatively low thermally conductive pathway between the first glass panel 12 and the second glass panel 14. Similarly, in the interest of providing a relatively low thermally conductive pathway between the first glass panel 12 and the second glass panel 14, the spacer 16 may be provided having a relatively small contact area with each of the first glass panel 12 and the second glass panel 14. For example, in an embodiment, the spacer 16 may have a contact surface on the order of approximately 1 mm by 1 mm. Of course, other contact surface dimensions may be equally utilized.

Further, the spacer 16 may be disposed within the viewing area of the VIG panel 10. In one embodiment, the spacer 16 may have a refractive index that may be generally the same, or close to the same as the refractive index of at least one of the first glass panel 12 and the second glass panel 14. Consistent with such an embodiment, a refractive index of the spacer 16 that is generally the same, or close to the same, as the refractive index of at least one of the first glass panel 12 and the second glass panel 14 may reduce and/or eliminate optical distortion caused by the spacer 16. Similarly, the spacer 16 may desirably be clear and/or have a color that may be generally the same as the color of one or more of the first glass panel 12 and the second glass panel 14. As with the refractive index of the spacer 16, a color (or clearness) generally the same as the color of one or more of the first glass panel 12 and the second glass panel 14 may reduce an optical impact on the VIG panel 10 caused by the spacer 16 (e.g., a visual artifact, such as distortion, or visual perceptibility). Further, desirably, the spacer 16 may resist color change (e.g., yellowing, etc.) upon prolonged exposure to light. Accordingly, a reduced optical impact caused by the spacer 16 may persist throughout at least a portion of the useful life of the VIG panel 10.

Additionally, it is often desirable to provide the spacers with a quality of lubricity. If a spacer does not have sufficient lubricity, the spacer may not allow sufficient relative movement between the spacer surfaces and their respective glass panels, thus reducing relative movement between the glass panels. Providing the spacer with sufficient lubricity is desirable for a number of reasons. First, depending upon the application, there may be relative movement between the glass panels of the VIG panel caused by thermal expansion between the two glass panels. For instance, the VIG panel may be used as a window for homes and buildings with one sheet of glass on the "outside" exposed to the elements and potentially subject to temperatures ranging from −20° C. to 40° C., and the other sheet of glass on the "inside" exposed to generally stable "room" temperatures of about 22° C. Accordingly, it is desired to allow the glass panels in the VIG panel to move independently relative to one another to accommodate thermal gradients across the VIG panel. Additionally, in certain applications, the VIG panel may be subject to wind loads, or mechanical flexing from being pushed or hit on one side or the other. The spacer matrix may also be damaged from excessive mechanical flexing of the glass panels. To limit any detrimental effects caused by mechanical flexing of the glass panels, it is often desired to provide the spacers with some degree of lubricity so that the glass panels may move independently of each other when flexed. Further, providing the spacers with lubricity allows a smaller spacer to be used in the matrix in the separation space of the VIG panel. Using a smaller spacer improves the aesthetic appearance and R-factor of the VIG panel, as the smaller spacers are less visible and the smaller spacers reduce the total cross sectional contact area and resultant thermal conductivity of the VIG panel.

Additionally, the hardness of the spacer 16 may be selected such that the compressive loading on the spacer 16 (e.g., due to the deflection of one or both of the first glass panel 12 and the second glass panel 14 toward the other) may not damage either of the first glass panel 12 or the second glass panel 14, or damage the spacer 16. For example, an excessive hardness of the spacer 16 relative to one or both of the first glass panel 12 and the second glass panel 14 may result in the spacer 16 digging into (e.g., indenting or scoring) one or both of the first glass panel 12 and the second glass panel 14. A resulting indentation or scoring in one or both of the first glass panel 12 and the second glass panel 14 may result in the creation of a flaw in one or both of the first glass panel 12 and the second glass panel 14, which may result in a failure of the glass panel at a lower stress than a failure stress of a glass panel not having a flaw. Correspondingly, if the hardness of the spacer 16 is excessively low, the compressive stress imparted on the spacer 16 may result in the deformation or failure (e.g., crushing) of the spacer 16. A desired hardness of the spacer 16 may be selected based upon, at least in part, a hardness of one or both of the first glass panel 12 and the second glass panel 14.

Referring still to FIG. 1, the VIG panel 10 may include a plurality of the spacers 16. The number of spacers may be based upon, at least in part, the size of the VIG panel 10. For example, the number and arrangement of the spacers between the first glass panel 12 and the second glass panel 14 may be selected to provide a desired resistance to deflection, lubricity, as well as a desired compressive loading on each spacer. In one embodiment, the plurality of spacers may be generally arranged in a matrix between the first glass panel 12 and the second glass panel 14. The spacers may, for example, be arranged in an approximately 4 cm by 4 cm grid. However, this embodiment should not be construed as a limitation on the present disclosure as other spacings may be equally utilized depending upon design criteria, as well as spacer and glass panel characteristics. Further, spacer arrangements other than a matrix may also be utilized, for example radial patterns, etc.

Figure 2:
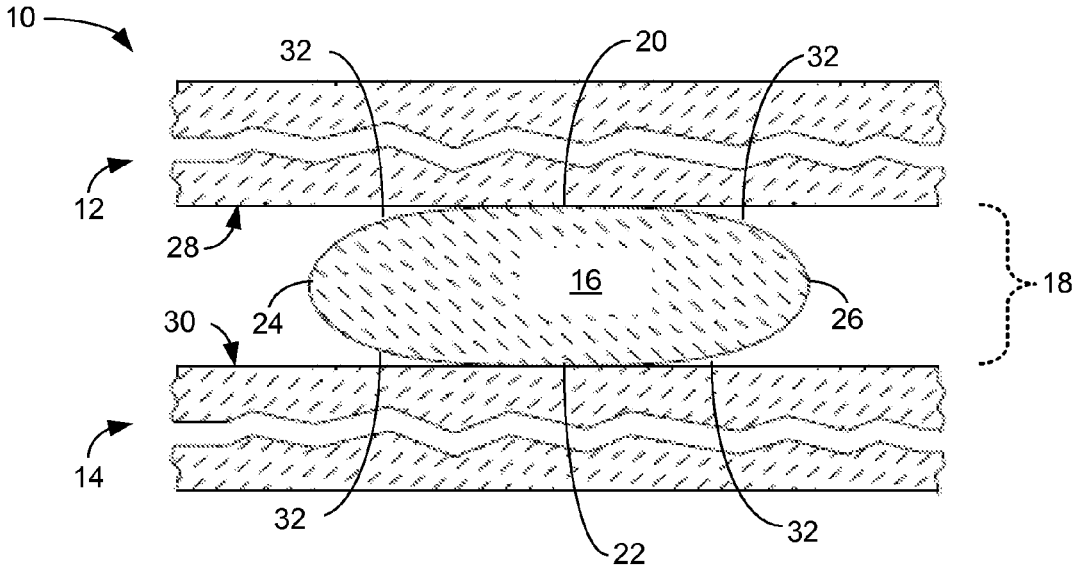
FIG. 2 depicts a cross-sectional view of the VIG panel of FIG. 1.
Figure 3:
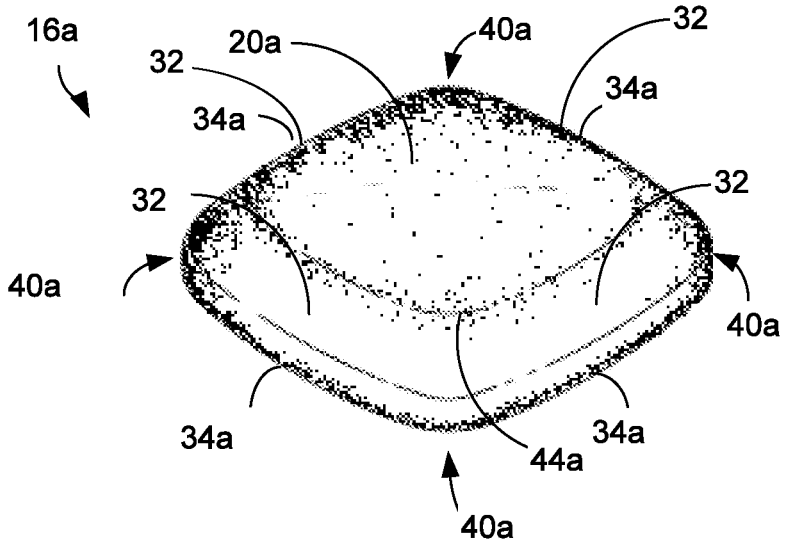
FIG. 3 diagrammatically depicts an embodiment of a spacer that may be used in a VIG panel.
Figure 4:
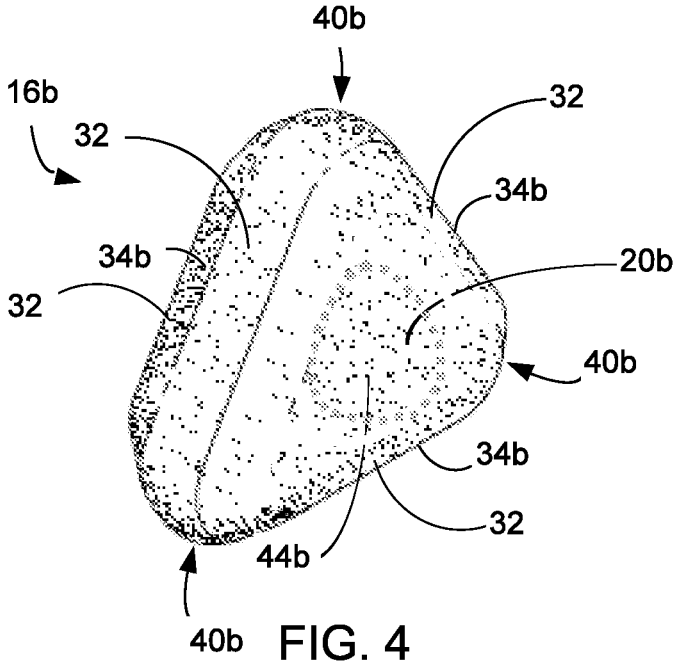
FIG. 4 diagrammatically depicts another embodiment of a spacer that may be used in a VIG panel.

FIGS. 2-4 show embodiments of a spacer that may be used in forming the VIG panel. It should be appreciated that spacers formed using processes other than those described herein may be disposed in the matrix of the VIG panel. Accordingly, the description of a spacer that follows is intended to be illustrative and not limiting in any sense.

In FIG. 2, the spacer 16 includes first and second generally opposed faces 20, 22. The spacer 16 may also include a plurality of sides (e.g., sides 24, 26 shown in the cross-section view of FIG. 2) extending between the first and second faces 20,22. For example, as shown in FIG. 2, the first face 20 of the spacer 16 may be generally adjacent to an inner surface 28 of the first glass panel 12, and the second face 22 of the spacer 16 may be generally adjacent to an inner surface 30 of the second glass panel 14. The first and second surfaces 20,24 are generally rounded off and/or formed with surface breaks 32 toward the coterminous edge of the respective face and side. As shown in the cross-sectional profile of FIG. 2, the surface breaks 32 may be generally rounded, and as shown in the illustrated embodiment, the surface breaks may be such that the sides 24, 26 are shown as a generally continuous curve. However, in other embodiments, the sides of the spacer 16 may include an at least partially flat region between the faces 20, 22 of the spacer 16. The rounded corners of the spacer 16 may minimize stress concentration of the glass panels 12, 14 arising from the glass panels deflecting against the spacer at the corners and edges.

Referring to FIGS. 3 and 4, illustrative examples of the generally polygonal periphery of the first and second faces 20,22 of the spacer (e.g., rectilinear spacer 16*a* and triangular spacer 16*b*) are shown. While illustrative examples of spacers suitable for use in the VIG panel 10 are shown having a rectilinear shape and a triangular shape, this should not be construed as a limitation of the present disclosure, as spacers having other polygonal peripheries may be equally utilized.

With particular reference to FIG. 3, the spacer 16*a* may include a plurality of sides 34*a* defining a polygonal (i.e., a rectilinear) periphery of the first face 20*a* and second face (not shown) of the spacer. In addition to the surface breaks 32 discussed above, the corners 40*a* of the sides 34*a* may be generally rounded. The generally rounded corners 40*a*, may reduce stress concentration at the spacer corners of the first and second glass sheets 12,14 when deflecting against the spacer 16*a*. In addition to the corners 40*a* being generally rounded, the sides 34*a* may also have an at least partially arcuate profile along their respective lengths. For example, the sides 34*a* may be generally arcuate and/or tapered toward each respective corner. Consistent with one embodiment, less than about 50% of each side (20, 22) may be optically flat (e.g., straight when analyzed relative to an optical flat). FIG.

4 shows a similar configuration for the spacer 16*b* that includes a plurality of the sides 34*b* defining a polygonal (i.e., triangular) periphery of the first face 20*b* and the second face (not shown) of the spacer 16*b*. In addition to the surface breaks 32 discussed above, the corners 40*b* of the sides 33*b* may be generally rounded, and the sides 34*b* may also have an at least partially arcuate profile along their respective lengths.

The spacers 16*a*, 16*b* shown in FIGS. 2-4 may be formed with surface breaks, corner breaks and general arcuate sides so as to form a contact footprint (FIG. 3, 44*a*; FIG. 4, 44*b*) upon which the respective glass panels rest. Preferably, the footprint on the spacer is circular. As will be described below, the polishing and tumbling processing of a spacer blank to produce a finish spacer tends to be more aggressive on the corners of the spacer blank. This tends to produce a generally circular contact footprint for the finished spacer. An illustrative example of a spacer may generally have a contact footprint dimension of approximately 1 mm by 1 mm, or a diameter of roughly 1 mm. Additionally, in such an illustrative example, the spacer may have a thickness in the range of about 150 microns to about 500 microns. Of course, other footprint dimensions and thicknesses may be equally utilized depending upon design preference and criteria.

According to one embodiment, the spacers 16 may generally be formed by cutting a plurality of spacer blanks having a generally polygonal periphery, as discussed above, from a sheet of glass. The spacer blanks may then be polished to at least partially round all of the corners of the blank (e.g., one or more of the corners 40*a*,40*b* between the sides 34*a*,34*b* of the polygonal periphery and/or one or more corners between the sides 34*a*,34*b* and the faces 20, 22 (i.e., surface breaks 32)). A finished spacer with softer or more broken corners and a near round or generally circular contact footprint shape allows for a more evenly distributed load and reduced edge stress risers. Polishing and tumbling processes allow for the elimination of stress risers from the corners. In some embodiments, the cutting and polishing of the spacer blanks may be carried out in a manner to minimize chipping in the final spacers. Examples of sheet glass may include, for example Schott D263® thin glass sheet, available from SCHOTT North America, Inc.; Schott AF-45, also available from SCHOTT North America, Inc.; Corning Gorilla® Glass, available from Corning Incorporated; Dragontrail Glass, available from ASG, or other suitable glass sheet stock having a generally high tolerance thickness.

Figure 5:
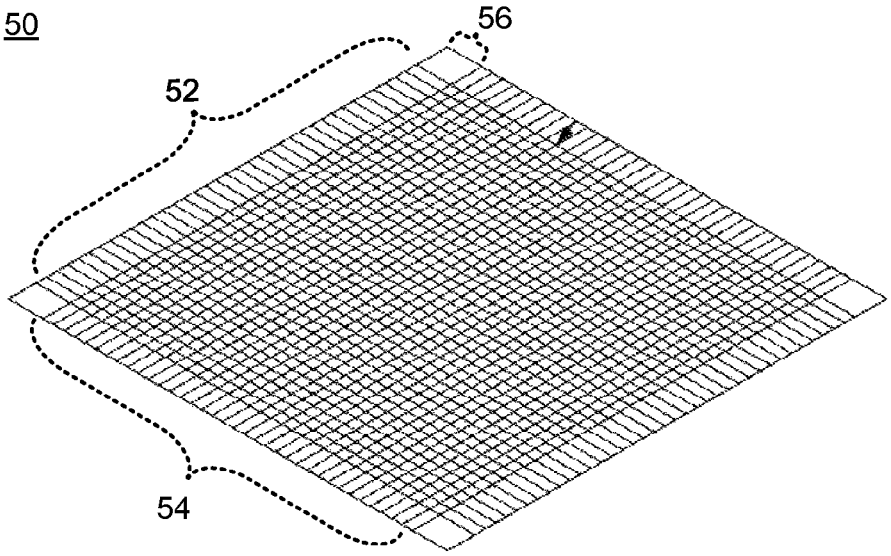
FIG. 5 diagrammatically depicts a glass sheet scribed to produce spacers for use in a VIG panel.

Cutting the plurality of spacer blanks may include scribing a sheet of glass to create a plurality of scribe lines in the sheet of glass. The glass sheet may be scribed using a computer numerical controlled scribing machine, or other suitable scribing techniques. For example, and referring also to FIG. 5, a glass sheet 50 may be scribed with a plurality of scribe lines (e.g., scribe lines 52, 54, generally) that may define the generally polygonal periphery of the spacer blanks. While FIG. 5 generally depicts scribe lines defining a generally rectilinear periphery, the glass sheet may be scribed to create scribe lines defining other polygonal peripheries, such as triangular, hexagonal, etc. As also shown in FIG. 5, the glass sheet 50 may be scribed to provide a margin 56 around the perimeter of the glass sheet 50. The margin 56 may reduce the likelihood of partial or damaged spacer blanks being formed around the perimeter of the glass sheet 50. Again referring to the illustrative example of a generally 1 mm by 1 mm spacer, the margin 56 may be about 4 mm to reduce the likelihood of partial or damaged spacer blanks and may reduce the likelihood of pieces coming from the edge being mistaken as spacer blanks.

Figure 6:
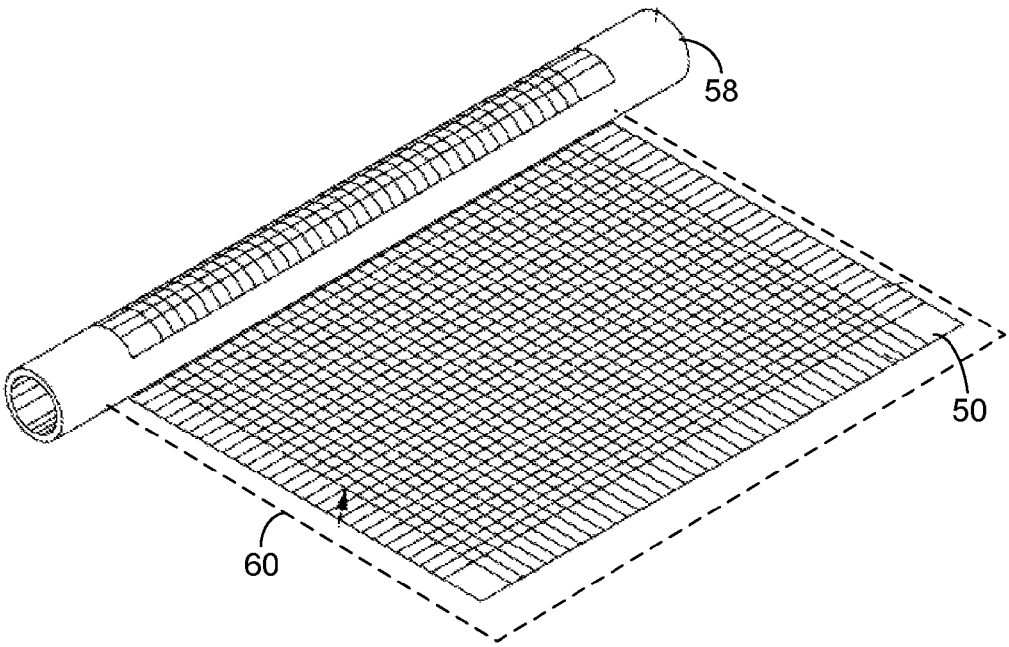
FIG. 6 diagrammatically depicts a roller used to break the scribed glass sheet of FIG. 5.

After being scribed, the glass sheet 50 may be broken along the plurality of scribe lines. According to one embodiment, breaking the glass sheet 50 may include supporting the glass sheet 50 on a relatively soft elastomeric sheet (e.g., a rubber sheet, silicone sheet, etc.) with the scribed side facing the elastomeric sheet and rolling a roller across the glass sheet in a direction perpendicular to the plurality of scribe lines to be broken. Referring also to FIG. 6, a roller 58 may be rolled across the glass sheet 50 in a direction generally perpendicular to the scribe lines 54 (e.g., the roller 58 may be oriented generally parallel to the scribe lines 54 and rolled across the glass sheet 50 in a direction generally perpendicular to the scribe lines 54) to break the glass sheet along the scribe lines 54. The roller 58 may also be rolled across the glass sheet 50 in a direction generally perpendicular to the scribe lines 52 to break the glass sheet along the scribe lines 52, thereby forming the spacer blanks having a generally rectilinear periphery consistent with the illustrative example. The elastomeric sheet (e.g., elastomeric sheet 60, shown in broken line) may generally support the glass sheet 50, while allowing sufficient compliance to break the glass sheet 50 along the scribe lines 52, 54. Supporting the glass sheet with the elastomeric sheet may include placing the glass sheet on one surface of the elastomeric sheet such that the side of the glass sheet including the plurality of scribe lines is against the surface of the elastomeric sheet. Further in an embodiment, the roller may be rolled across the opposite surface of the glass sheet and/or rolling the glass sheet and elastomeric sheet about the roller. The roller 58 may, for example, have a diameter that may be on the order of ten times a maximum dimension of each spacer blank. However, the diameter of the roller may vary depending upon process requirements, and user preference.

It will be appreciated that for other polygonal peripheries, such as triangular, additional sets of scribe lines may be created (e.g., three total sets of scribe lines in the case of spacer blanks having a generally triangular profile). Accordingly, the number of passes of the roller may generally correspond to the number of sets of scribe lines. Similarly, the orientation of each pass by the roller may vary according to the orientation of each set of scribe lines.

According to an embodiment, breaking the sheet of glass may include adhering a dicing tape to a side of the glass sheet opposite the plurality of scribe lines. The dicing tape may include, for example, a tape having a pressure sensitive adhesive that may be at least partially released upon exposure to ultraviolet light. The dicing tape may be applied to the glass sheet before the glass sheet is scribed to create the plurality of scribe lines or after the glass sheet is scribed. According to one embodiment, the dicing tape may retain the spacer blanks once the glass sheet has been broken. Retaining the spacer blanks on the dicing tape may, for example, facilitate collection of the spacer blanks following breaking of the glass sheet, and may reduce damage to the spacer blanks following breaking of the glass sheet.

At least a portion of the plurality of spacer blanks may be released from the dicing tape after breaking the sheet of glass. For example, once the glass sheet has been broken to produce the plurality of spacer blanks, the spacer blanks and dicing tape may be exposed to ultraviolet light to at least partially release the spacer blanks from the dicing tape. Further, the spacer blanks may be fully released from the dicing tape, for example, using one or more solvent baths. Suitable solvents may include, but are not limited to, acetone and methanol. In some embodiments, sequential acetone and methanol baths may be utilized. Additionally, release of the spacer blanks from the dicing tape may also be facilitated, e.g., by flexing or rolling the dicing tape with the spacer blanks on the convex side of the flexed or rolled dicing tape. The full release of the spacer blanks from the dicing tape may allow the spacer blanks to be capture (e.g., in the solvent bath). The spacer blanks may be separated from any waste (e.g., pieces of the glass sheet 50 from the margin 56) using one or more appropriately sized sieves. For example, a sieve stack including 1.4 mm, 1.18 mm, and 0.5 mm sieves may be utilized to separate 1 mm×1 mm square spacer blanks from any waste. Additionally/alternatively, at least a portion of the waste such as the margin area may be removed prior to fully releasing the spacer blanks from the dicing tape.

While the spacer blanks may be suitably cut via the scribing techniques described above, various additional/alternative cutting techniques may be equally utilized. For example, cutting the plurality of spacer blanks may include cutting the plurality of spacer blanks using one or more of a saw, a laser, or a water jet. Further, consistent with the use of a saw (such as a diamond saw), a laser, or a water jet it may be possible to cut more than one glass sheet at a time. For example, several glass sheets may be stacked on top of one another. The stacked glass sheets may all be cut in a single cutting operation. Various additional/alternative cutting processes may similarly be utilized.

Polishing the spacer blanks may include tumbling the spacer blanks with a polishing compound. Polishing the spacer blanks with a polishing compound may result in rounding one or more corners to yield a spacer blank as generally described above, and shown, e.g., in FIGS. 2 through 4. Polishing the spacer blanks may include, for example, polishing the spacer blanks in a tumbler in the presences of a polishing compound. The polishing compound may include an aluminum oxide, diamond, or cerium based (e.g., cerium oxide) polishing compound. Of course various additional polishing compounds may be utilized. In an illustrative example, the spacer blanks may be tumbled in the presence of glass balls and one micron polishing powder. The glass balls may include, for example, 4 mm diameter glass balls. Further, the polishing compound may be provided as a slurry, e.g., through the addition of water, methanol, or other suitable fluid to the tumbler. Tumbling of the spacer blanks may proceed until the spacers have a desired degree of rounding of the corners. To this end, samples of the spacer blanks may be periodically removed from the tumbler and examined. Examination may, for example, utilize an optical flat, by which the degree of rounding may be ascertained.

In addition/as an alternative to mechanical polishing using a polishing compound, the spacer blanks may be chemically etched to achieve the desired rounding of the corners. Suitable etchants may include, but are not limited to, ammonium bifluoride (ABF) and hydrofluoric acid (HF). In one such example, the spacer blanks may be placed in a bath of etchant and may be agitated until the desired degree of rounding of the corners of the spacer blanks is achieved. During such a chemical etching process, etching may preferentially occur at the corners of the spacer blanks, thereby providing spacers having a desired rounding of the corners.

Following mechanical and/or chemical polishing, the spacers may be thermally polished at an elevated temperature. Thermally polishing the spacers may reduce or remove cracks, scratches, chips, or other irregularities or defects that may be present in the spacers. In some instances, thermally polishing the spacers may at least partially soften the spacers during the thermal polishing process and may smooth any scratches or chips resulting from, or remaining after, the mechanical polishing process and/or the scribing process. Consistent with one illustrative example, the spacers may be thermally polished at a temperature of about 630° C. for a duration of about three hours. It will be appreciated that other time and temperature parameters may be effectively utilized. Preferably, the spacers are thermally polished immediately prior to being sealed into clean packaging. This ensures most, if not all, contaminates on the surfaces are burned off in the thermal polishing process and the surfaces of the spacer are as clean as possible.

In addition to polishing the spacer blanks, the resultant spacers may be chemically strengthened. For example, the spacers may be immersed in an ion bath at an elevated temperature. The ion bath may result in an ion exchange at the surface of the glass creating a uniform surface compression layer. The surface compression layer may increase the strength of the spacers. An example of an ion bath may include a bath containing a potassium salt, such as potassium nitrate at a temperature greater than 380° C. Of course, other ion baths and temperatures parameters may be effectively utilized.

At one or more stages of production, the spacers and/or spacer blanks may be cleaned. For example, the spacer blanks may be cleaned prior to polishing, after polishing, prior to thermal polishing, after thermal polishing, prior to chemical strengthening, and/or after chemical strengthening. Various suitable cleaning processes may be utilized. For example, various solvents, such as acetone and methanol, for example, may be utilized. Further, cleaning may include multiple solvent baths utilizing different solvents, for example, acetone and methanol may be used sequentially. Further, cleaning may be carried out using an ultrasonic bath and/or at an elevated temperature (e.g., at a temperature of 40° C.). However, it will be appreciated that various solvents, temperatures, and cleaning techniques may be utilized. Similarly, various cleaning agents and detergents, such as surfactants, may also be utilized. Cleaning of the spacers and/or spacer blanks may also include the removal of organic residuals. For example, organic residuals may be burned off at an elevated temperature (e.g., a temperature of about 350° C.) and in the presences of oxygen or air.

Figure 7:
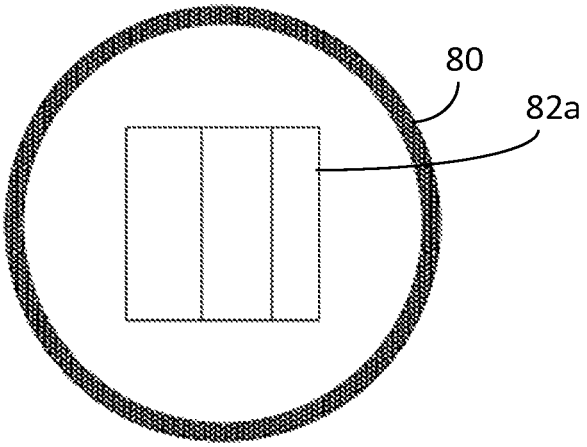
FIGS. 7 through 9 diagrammatically depict optical flat measurements of a spacer as it undergoes successive processing to establish sufficient rounding of its edges.
Figure 8:
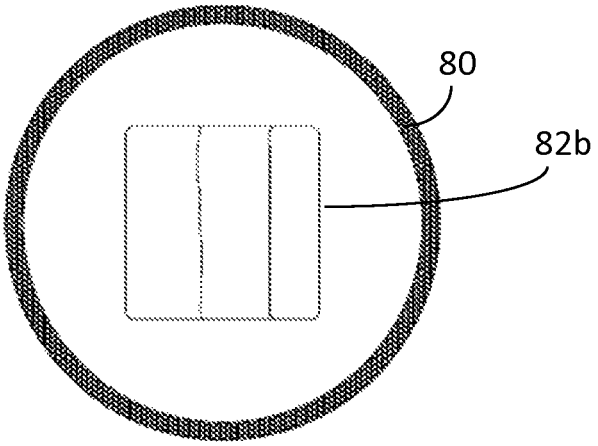
Figure 9:
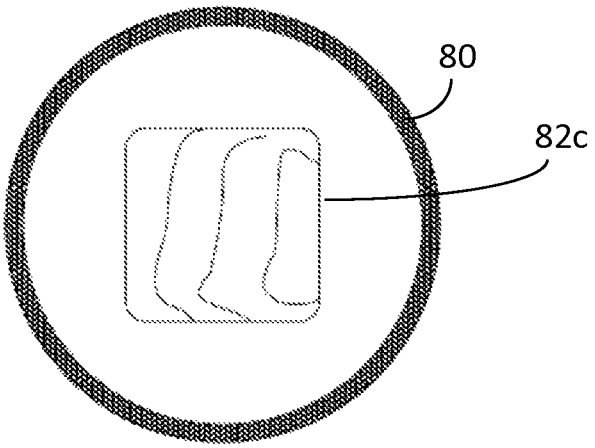

Referring also to FIGS. 7 through 9, and as briefly mentioned above, the spacers may be inspected for the desired degree of corner rounding through the use of an optical flat measuring device 80, such as one provided by Edmund Optics, part number NT43-412-000, 1/20Lambda Zerodur Optical Flat. Measurements 82*a*,82*b*,82*c* may be periodically taken on samples of spacers during processing to ensure a desired amount of rounding of the spacer is achieved. For illustrative purposes, FIG. 7 shows representative flatness measurements 82*a* of a spacer blank before processing (i.e., before any polishing and rounding of the edges) taken via an optical flat measuring device. FIG. 8 shows representative flatness measurements 82*b* of a semi-finished spacer blank during processing for rounding and polishing of the edges taken via an optical flat measuring device. In FIG. 8, the optical flat measurement device shows lines that bend as the spacer face deviates from flat. A processed spacer tends to be flat on its faces with radiused breaks from the flat towards the ultimate edge. The optical flat measurement device 80 precisely indicates the point on the spacer face where the surface break begins, and the amount of surface break. In other words, the optical flat measuring device may determine the transition point where the generally flat contact footprint area ends the surface break begins. Preferably, the transition between the surface break and the contact footprint flat is very gradual to prevent concentration of stress on the glass panel from deflection inward into the separation space around the contact footprint of the spacer. FIG. 9 shows representative flatness measurements 82*c* of a spacer with sufficient processing.

The spacers may be processed in a batch operation, thereby allowing many spacers to be polished in a mechanical or chemical polishing system at the same rate. Periodically, a sufficient sample of spacers may be removed from the polishing and/or tumbling operation and measured on the optical flat measuring device. Once sufficient breaks are measured on the optical flat measuring device, the batch polishing operation may be completed. Thereafter, the spacers may be assembled in the VIG panel.

As described above, it is often desirable to provide the spacers with a quality of lubricity. One way to provide lubricity is to coat the spacers, which may be formed using one or more of the methods above, with a coating material. For instance, the coating material may be applied to the spacers after finished dimensions for the spacer are achieved and measured, and after a cleaning process, such as described above. Preferably, the spacers are coated with a coating material comprising particles having a particle size of around 1 micron. The coating thickness may be in a range of 150 microns to 250 microns. Preferably, the coating material particles enable the spacers to exhibit a low coefficient of friction. A low coefficient of friction allows the two sheets of glass to move easily with respect to each other, and with the spacers, with minimum stress on any of the VIG panel components. Additionally, the coating material particles preferably have a hardness that is less than the glass panels of the VIG panel and the spacer, thereby reducing the potential for scratches to develop when there is movement between the glass panels and/or the spacers. Preferably, the coating material comprises polytetraflouroethlyene (PTFE) particles having a size range of 200 nanometers to 700 nanometers. A PTFE product known as "nanoFLON™ P39B Thermalpastic grade PTFE" provided by Shamrock Technologies has proven effective. A coating material comprising polymer coated silver nanoparticles may also be used. A silver nanoparticle product known as "Silver Nanopowder self-dispersing part number 0127SH" provided by Skyspring Nanomaterials may also be used.

The coating material may be applied to the spacers in a vessel in the manner described below. A vessel in communication with a source of inert gas may be provided. The vessel may be a polyethylene-lined vessel and the inert gas may comprise dry nitrogen. The vessel may be rigid or may comprise a flexible enclosure such as a polyethylene bag or glovebox. To prepare the vessel, the nitrogen source may be aligned with the vessel to purge the vessel. The purging process removes air and creates a dry, static charge on the walls of the vessel. The polyethylene lining assists in creating these conditions in the vessel. For instance, when using a polyethylene bag, the bag may be filled and emptied of nitrogen 3 times to provide the necessary conditions. Generally speaking, optimum coating conditions are created when the inside of the vessel is dry and clean. Next, clean and dry spacers may be introduced to the vessel along with a desired amount of the coating material to achieve a selected thickness of the coating material on the spacers. The vessel may be purged with an inert gas again to reestablish clean and dry conditions in the vessel after introduction of the spacers and coating material without excessively disturbing the contents of the vessel during the purge. The vessel may then be agitated to enable the coating material to electrostatically coat the surfaces of the spacers. The agitation time depends upon the amount of the spacers and the coating material in the vessel. After agitation, the contents of the vessel may be removed and inspected and packaged for later operations, including sintering and/or use directly in the matrix of the VIG panel. It is desired that the packaging maintain the spacers dry and clean prior to the next operation. Sintering may be performed to bond the coating material to the spacers. The sintering temperature may be determined by the material used. Once the coating material has been sintered on the spacers, the coated spacers may be aggressively shaken on a sieve to remove excessive and/or loosely held coating material. This allows cleaner manufacturing processing and subsequent operations, for instance, when the spacers are used in the matrix and placed on the glass panels during final assembly of the VIG panel. In one embodiment the entire coating operation is performed in a suitable dry glovebox, thereby further ensuring the coating is kept dry and clean.

The embodiments were chosen and described in order to best explain the principles of the invention and its practical application to thereby enable others skilled in the art to best utilize the invention in various embodiments and with various modifications as are suited to the particular use contemplated. As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A method of forming a vacuum insulated glass (VIG) panel comprising:

providing a plurality of spacers and a coating material to be applied to the spacers;

introducing the plurality of spacers and the coating material into a vessel, the coating material comprising particles having an average size of less than 1 micron;

agitating the vessel to coat the spacers with the coating material;

inserting the coated spacers between opposed first and second glass panels to form the VIG panel;

wherein the VIG panel comprises first and second panels of glass spaced from another with a separation space therebetween;

wherein the spacers are disposed between the first and second glass panels to define the separation space; and wherein the spacers are disposed between the first and the second glass panels.

2. The method of claim 1, wherein the coating material comprises polytetrafluoroethylene particles.

3. The method of claim 2, wherein the polytetrafluoroethylene particles have an average particle size in the range of about 200 nanometers to about 700 nanometers.

4. The method of claim 1, further comprising sintering the coating material on the spacers.

5. The method of claim 1, further comprising removing loosely held coating material from the spacers.

6. The method of claim 1, wherein the step of providing the plurality of spacers further comprises:

cutting a plurality of spacer blanks having a generally polygonal periphery from a sheet of glass;

polishing the spacer blanks to at least partially round one or more corners of the spacer blanks to form the spacers.

7. The method of claim 6, wherein the step of providing the plurality of spacers further comprises:

using an optical flat measuring device to measure an amount of rounding of the corners of the polygonal periphery of the spacer blank during polishing operations.

8. The method of claim 6, wherein the step of polishing the plurality of spacer blanks further comprises thermally polishing the spacer blanks at an elevated temperature.

9. The method of claim 6, wherein the step of polishing the plurality spacer blanks includes chemically etching the spacer blank.

10. The method of claim 6, wherein the step of providing the plurality of spacers further comprises chemically strengthening the spacer in an ion bath.

11. The method of claim 6, further comprising rounding corners of the plurality of spacers to form a generally circular footprint on opposed surfaces of the spacers that contact the respective glass panel when assembled with the VIG panel.

12. The method of claim 1, wherein a thickness of the coating material on the spacers is about 150 microns to about 250 microns.

* * * * *